United States Patent [19]

Andree et al.

[11] Patent Number: 4,820,436

[45] Date of Patent: Apr. 11, 1989

[54] DETERGENTS FOR LOW LAUNDERING TEMPERATURES

[75] Inventors: Hans Andree; Horst Baumann, both of Leichlingen; Manfred Biermann, Mulheim; Frantisek Jost; Horst-Juergen Krause, both of Duesseldorf; Fritz Lange, Essen; Herbert Leiter; Alfred Meffert, both of Monheim; Uwe Ploog, Haan; Harald Schnegelberger, Leichlingen; Eduard Smulders, Hilden; Eric Sung, Monheim; Andreas Syldatk, Duesseldorf; Guenter Uphues, Monheim; Guenther Vogt, Toenisvorst, all of Fed. Rep. of Germany

[73] Assignee: Henkel Kommanditgesellschaft auf Aktien, Duesseldorf, Fed. Rep. of Germany

[21] Appl. No.: 19,278

[22] PCT Filed: Jun. 16, 1986

[86] PCT No.: PCT/EP86/00356

§ 371 Date: Feb. 20, 1987

§ 102(e) Date: Feb. 20, 1987

[87] PCT Pub. No.: WO86/07603

PCT Pub. Date: Dec. 31, 1986

[30] Foreign Application Priority Data

Jun. 22, 1985 [DE] Fed. Rep. of Germany ..... 3522389
Mar. 3, 1986 [DE] Fed. Rep. of Germany ..... 3606828

[51] Int. Cl.[4] ..... C11D 3/26; C11D 3/28; C11D 3/18; C11D 3/30

[52] U.S. Cl. ..... 252/544; 252/529; 252/548; 252/525; 252/174.22; 252/174.25; 252/90; 252/91

[58] Field of Search ..... 252/529, 544, 548, 525, 252/174.22, 174.25, 90, 91

[56] References Cited

U.S. PATENT DOCUMENTS

| | | | |
|---|---|---|---|
| 2,383,525 | 8/1945 | Tucker | 252/542 |
| 2,527,076 | 10/1950 | Preston | 252/117 |
| 2,703,798 | 3/1955 | Schwartz | 252/548 |
| 2,965,576 | 12/1960 | Wilson | 252/529 |
| 3,223,644 | 12/1965 | Law | 252/106 |
| 3,454,494 | 7/1969 | Clark et al. | 252/8.8 |
| 3,691,081 | 9/1972 | Thompson et al. | 252/174.22 |
| 3,741,912 | 6/1973 | Kaneko | 252/529 |
| 3,849,347 | 11/1974 | Tokiwa et al. | 252/545 |
| 3,925,224 | 12/1975 | Winston | 252/89 |
| 4,064,063 | 12/1977 | Alder et al. | 252/135 |
| 4,083,793 | 4/1978 | Jakobi et al. | 252/99 |
| 4,136,051 | 1/1979 | Saran et al. | 252/91 |
| 4,169,074 | 9/1979 | Conrad et al. | 252/544 |
| 4,169,075 | 9/1979 | Kuhling et al. | 252/558 |
| 4,171,278 | 10/1979 | Andree et al. | 252/102 |
| 4,264,464 | 4/1981 | Gangwisch et al. | 252/91 |
| 4,274,974 | 6/1981 | Kerkhoven | 252/90 |
| 4,276,326 | 6/1981 | Joshi | 427/220 |
| 4,288,339 | 9/1981 | Wilsberg | 252/90 |
| 4,650,865 | 3/1987 | Lange et al. | 544/174 |
| 4,675,124 | 6/1987 | Seiter et al. | 252/91 |

FOREIGN PATENT DOCUMENTS

| | | |
|---|---|---|
| 0025551 | 9/1982 | European Pat. Off. . |
| 0094655 | 11/1983 | European Pat. Off. . |
| 112593 | 7/1984 | European Pat. Off. . |
| 121949 | 10/1984 | European Pat. Off. . |
| 2338386 | 9/1974 | Fed. Rep. of Germany . |
| 2412837 | 10/1974 | Fed. Rep. of Germany . |
| 2733969 | 2/1979 | Fed. Rep. of Germany . |
| 3444960 | 6/1986 | Fed. Rep. of Germany . |
| 3504242 | 8/1986 | Fed. Rep. of Germany . |
| 2703020 | 9/1986 | Fed. Rep. of Germany . |
| 3522389 | 1/1987 | Fed. Rep. of Germany . |
| 1118024 | 5/1956 | France . |
| 1159770 | 7/1958 | France . |
| 1353694 | 2/1963 | France . |
| 1027898 | 4/1966 | United Kingdom . |
| 1067762 | 5/1967 | United Kingdom . |
| 1087413 | 10/1967 | United Kingdom . |

OTHER PUBLICATIONS

R. Brdicka, *Grundlagen der physikalischen Chemie* (VEB Deutscher Verlag der Wissenschaften, Berlin, 1973), pp. 609–610.

*Primary Examiner*—Paul Lieberman
*Assistant Examiner*—Ronald A. Krasnow
*Attorney, Agent, or Firm*—Ernest G. Szoke; Henry E. Millson, Jr.; Real J. Grandmaison

[57] ABSTRACT

Detergents on the basis of anionic and nonionic surfactants contain as laundering power-enhancing additives an aliphatic amine compound which is selected such that its $pK_b$ value is at least equal to 14, minus the initial pH value of a 1% aqueous solution of the detergent containing the amine compound. Laundering power-enhancing amine compounds selected according to the rule mentioned are certain ether amines, amidoamines, glucamine derivatives or morpholine derivatives.

7 Claims, No Drawings

DETERGENTS FOR LOW LAUNDERING TEMPERATURES

As a result of the increasing preference for easy-care textiles made of synthetic fibers, and also as a result of the constantly increasing energy costs along with the rising environmental consciousness of detergent users, the previously customary boiling laundering has been increasingly displaced by laundering at 60° C. In the case of many commercial detergents the applicability for textile laundering at 40° C., 30° C., or room temperature is also praised. In order to achieve satisfactory laundering results, comparable to those of laundering with boiling, especially high demands are imposed on the composition of the low temperature laundry detergents. Whereas for better removal of bleachable soils from the textiles, a cold bleach activator was added to the usual boilable laundry detergent containing perborate or percarbonate, or to the wash bath prepared with it, in order to improve the capability for washing out grease and pigmented soils at temperatures of about 60°0 C. or less it was necessary to enhance the laundering power of the previously used surfactants with the aid of certain additives. Thus in U.S. Pat. No. 3,925,224, from 1975, addition of water-insoluble surfactant types from the group of anionic, nonionic and amphoteric surfactants to the customary detergent formulations on the basis of inherently water-soluble surfactants was recommended. The water-insoluble nonionic surfactants also include ethoxylated alkylamines with $C_8$–$C_{21}$ alkyl chains and with 1 to 6 mol added ethylene oxide, for example coconut alkylamine reacted with 2 mol ethylene oxide. In German Preliminary Published Application No. 2,703,020, reaction products of long-chain epoxyalkanes, having terminal or internal epoxy groups, with monoethanolamine or diethanolamine, or with aliphatic polyamines are described, wherein the reaction products can additionally be ethoxylated or propoxylated. Hydroxyalkylamines of this type, which are likewise poorly soluble in water, are recommended for intensifying the laundering power of anionic, nonionic and zwitterionic surfactants in laundry detergent preparations which are also suitable for laundering at lower temperatures. From European Patent Application No. 112,593, laundry detergents containing ethoxylated mono- and diamines as well as ethoxylated polyethyleneamines and polyethyleneimimes are known, which are water-soluble as a result of accumulation of polyglycol ether groups as well as the absence of long-chain hydrophobic groups. Detergents with these water-soluble ethoxylated amines added are said to be characterized by improved removal of clay-type pigments as well as by improved graying inhibition. In European Patent Application No. 121,949, among other things, tertiary amines with two $C_4$–$C_{10}$ alkyl groups and a third, shorter alkyl or hydroxyalkyl group as well as quaternary ammonium compounds derived from this are described as laundering strength-enhancing additives to synthetic anionic surfactants. The two $C_4$–$C_{10}$ alkyl groups in the tertiary amine can be linked with the nitrogen atom over 1 to 3 ethyleneoxy bridges, wherein it should be true that the $pK_a$ value of the tertiary amine is at least about one-half unit above the initial pH value of the wash bath.

Soap-containing detergents are known from U.S. Pat. No. 2,527,076 (German Pat. No. P 3748) which contain surfactants of the sulfonate or sulfate type as well as alkyl-substituted fatty acid amides which act as lime soap dispersants. Nonionic surfactants, especially those of low solubility in water, are not present in the agents. The use of fatty acid derivatives of aliphatic diamines and polyamines as well as their ethoxylates as cleaning enhancers in chemical cleaning is known from French Pat. No. 1,118,024. According to U.S. Pat. No. 3,454,494, the same compounds are used as scrooping additives to textile laundry detergents. Fatty acid derivatives of alkyl-substituted diamines and mixtures thereof with nonionic surfactants poorly soluble in water are not mentioned in these documents.

Fatty acid amides of alkyl-substituted alkylenediamines, especially N-lauroyl-N'-dimethyl-propylenediamine, are used in the form of their salts according to German Pat. No. 2,338,286 as disinfecting active ingredients in hand disinfectants. However, in a customary textile laundry detergent with its alkaline reaction, the salt-like character and thus the disinfecting action are lost. A teaching of the contents, to use these compounds in the form of the free amidoamines in textile laundry detergents with a surfactant component selected in a certain way, is not disclosed in this reference.

From German Pat. No. 2,226,925-A1 (U.S. Pat. No. 3,849,347), a gel-like agent is known, with which the fat-soiled textiles are pretreated. This agent contains a mixture of "oleophilic" nonionic surfactants and anionic surfactants of the sulfate or sulfonate type. Nonionic components used include, for example, lauryl alcohol-myristyl alcohol mixtures reacted with 3 mol ethylene oxide, or nonylphenol reacted with 5 mol ethylene oxide. The preferred anionic surfactant is linear alkylbenzenesulfonate. However, that use of this material is tedious and time-consuming, since it requires applying the gel-like cleaning material in advance and allowing the textile material to stand for 1 to 30 min before it is placed in the washing machine. These agents can usually be incorporated only with difficulty in a customary, granular all-purpose laundry detergent because of their gel-like character.

It is known from U.S. Pat. No. 3,925,224 that the addition of a water-insoluble surfactant, known as an "additive", to laundry detergents containing the customary water-soluble anionic, nonionic or zwitterionic surfactants leads to an increase in the laundering power. Examples of water-insoluble "additives" include ethoxylated alcohols with 12 to 15C atoms or octylphenol, in each case with 3 glycol ether groups (EO), ethoxylated coconut amine with 2 EO groups, fatty acid diethanolamides, ethoxylated fatty acid amides, and free fatty alcohols. Fatty acid amides which are free from hydroxyalkyl groups are not mentioned. The additives can be added to the detergents or the wash liquors in solid or liquid form. Solid, i.e., powdered additives can consist of 0.1 to 60 wt% additive or a mixture thereof with water-soluble surfactants, as well as 99.9 to 40 wt% carrier material, such as builder salts, fillers, bleaching agents or other detergent constituents. The additives are mixed with these materials in order to prevent aerosol formation in the exhaust air from the spray towers (pluming) during spray drying. The additives mentioned are essentially oily materials, which on the basis of their tendency toward adhesion can only be incorporated with difficulty in large amounts, i.e., amounts exceeding 5 to 8%, in conventional laundry powders and carrier materials, since they interfere with the free-flowing nature of the products. No suggestion for a way of incorporating large amounts, especially up to 60% of these additives into known powdered "builders" and fillers without interfering with their free-flowing ability is presented in U.S. Pat. No. 3,925,224.

The suggestions of the state of the art also show other disadvantages. Thus the ethoxylated fatty alkylamines have a more or less distinct inherent odor, which interferes with their use in high quality detergent brands, and must be neutralized by special perfuming procedures. In the case of the hydroxyalkylamines derived from terminal and internal long-chain epoxyalkanes, today their production from petroleum, as a nonrenewable raw material, is regarded as a disadvantage. In the case of the water-soluble ethoxylated amines, a contribution to improving the lipid removal ability, which is particularly problematic at low temperatures, is not always recognizable. Finally tertiary amines, which are almost always completely protonated, set narrow limits on practical application.

The invention is based on the task of discovering substances, able to be manufactured from renewable raw materials and having no inherent odor that interferes with their application technology, the problem-free incorporation of which into laundry detergents improves the laundering action of these agents at low laundering temperatures. One goal of the invention is that of preparing such laundering power-enhancing substances as amine derivatives of lipid raw materials. It is an additional goal of the invention to discover such amine derivatives, able to be manufactured from fats, which bring about a superadditive enhancement of efficacy at the low laundering temperatures even when relatively small amounts are used, i.e., in amounts which are distinctly deficient relative to the actual surfactants. A further goal of the invention consists of supplying a granular laundry detergent which avoids the disadvantages of the known agents and is characterized by a high laundering capacity, especially against fat- and oil-containing soils. In this process the laundering power enhancing additives are to be incorporated in the detergent without the powder texture being impaired by this or without undesirable exhaust air problems arising during spray drying in the manufacturing of the agents. An additional essential goal of the invention consists of discovering a selection criterion for the amine compounds coming under consideration as laundering power enhancers, as a result of which it is possible to supply laundry detergents which are optimized to the pH value of the wash liquor prepared from this in terms of laundering power enhancing activity and to the minimum utilization quantity, especially of the amine compounds.

Correspondingly, the present invention consists of a laundry detergent containing at least one synthetic anionic and/or nonionic surfactant and an aliphatic amine compound, wherein the amine compound is selected such that its $pK_b$ value is at least equal to 14 minus the initial pH value of a 1% aqueous solution of the detergent. The pH value in this connection is based on a detergent containing the amine compound mentioned. The $pK_b$ value represents the negative base-ten logarithm of the equilibrium constant for the amine compound under the conditions of the hydrolysis equilibrium:

$$K_b = \frac{(\text{amine } H^+)(OH^-)}{(\text{amine})} \quad (1)$$

Thus for the $pK_b$ value we have:

$$pK_b + pK_a = 14 \quad (2)$$

$$pK_b = 14 pK_a \quad (3)$$

The $pK_b$ value is determined by titrating an aqueous solution of the amine compound with a strong acid. If the course of the pH value during the titration is plotted as a function of the added acid quantity, the equation $$pK_b = 14 - \text{pH} \quad (4)$$

applies for the point of the curve where half of the amine substance exists in protonated form.

These relationships are described, for example, in R. Brdicka, *Fundamentals of Physical Chemistry* (*Grundlagen der Physikalischen Chemie*), 12th Edition, pp. 609 and 610, VEB Deutscher Verlag der Wissenschaften, Berlin 1973.

This $pK_b$ value is a characteristic value for protonatable amine compounds within the framework of this invention, serving as a selection criterion for suitable amine compounds according to the equation (5):

$pK_b$ is at least equal to 14 minus the pH value of a 1 wt% aqueous solution of the detergent containing the amine compound.

The $pK_b$ value is generally between 4 and 9.

The selection criterion mentioned makes it possible to make an optimal selection in terms of the suitable compound type and the quantity required for use. In the $pK_b$ value range mentioned, especially suitable laundering power enhancing substances are those which have a low $pK_b$ value. However, substances are also suitable in which the difference between the $pK_b$ value and the pH value of the 1 wt% detergent solution is not less than about 1. This is especially true for substances with approximately the same solubility in water. It is presumed that the detergents in accordance with the invention have especially good laundering activity at both low and high laundering temperatures, since the type and quantity of laundering power enhancing amine compounds are optimally adjusted to the pH value buffering characteristics of the laundry detergents made up by using the teaching in accordance with the invention, especially in terms of their builder components.

Typical detergents of improved laundering power contain at least one amine compound from the group including the following:

(a) ether amines of the general formula $$R^1—(OCH_2CH_2)_x—NR^2R^3 \quad (I)$$

in which $R^1$ represents an alkyl, hydroxyalkyl or alkenyl group with 6 to 22C atoms, x represents a numerical value from 1 to 10, $R^2$ and $R^3$ independently of one another represent alkyl groups with 1 to 4C atoms, the group $H(OCH_2CH_2)_y$ with y=1 to 6, or together with the nitrogen atom form a 5- or 6-membered ring, which can contain an additional nitrogen or oxygen atom, or one of the groups $R^2$ or $R^3$ also represents hydrogen;

(b) amidoamines of the general formula $$R^4—CO—NR^5—(CH_2)_n—NR^6R^7 \quad (II)$$

wherein n=2 to 4, $R^4$ represents an alkyl or alkenyl group with 9 to 17C atoms, $R^5$, $R^6$ and $R^7$ represent hydrogen or $C_1$ to $C_3$ alkyl groups, with the specification that at least one of the groups $R^5$, $R^6$, $R_7$ represents an alkyl group;

(c) alkyl, alkenyl or hydroxyalkyl derivaties of glucamine, in which the alkyl, alkenyl or hydroxyalkyl group has 6 to 22C atoms;

(d) alkyl, alkenyl or hydroxyalkyl derivatives of morpholine, in which the alkyl, alkenyl or hydroxyalkyl group has 6 to 22C atoms.

The ether amines (a), in which $R^1$ is an alkyl, hydroxyalkyl or alkenyl group, are described in German Patent Application No. P 3,522,389, which was not published anticipatorily; the amidoamines (b) are constituents of the detergents of the likewise not anticipatorily published German Patent Application No. P 3,606,828. In particular, the detergents in accordance with the invention contain:

3–40 wt% anionic and/or nonionic surfactants
0.1–5 wt% amine compound
5–80 wt% water-soluble and/or insoluble inorganic and/or water-soluble organic builder salts.
0–30 wt% inorganic per-compounds, releasing $H_2O_2$ in aqueous systems, preferably perborate
remainder compounds otherwise customary in laundry detergents.

The ether amines described in the older application are especially those ether amines of General Formula 1 in which the substituent $R^1$ involves alkyl or alkenyl groups obtainable from technical fatty acids and existing in the fatty alcohols able to be manufactured from them. Especially preferred are residues $R^1$ with essentially 10 to 20 carbon atoms, especially with essentially 12 to 18 carbon atoms in the alkyl or alkenyl group. Substances of Formula I are preferably used in which the substituents $R^2$ and $R^3$ both represent the ethoxy group $H(OCH_2CH_2)_y$. Also preferably used are compounds of Formula I in which one of the groups $R^2$ or $R^3$ has the ethoxy group mentioned and the other represents a $C_1$–$C_4$ alkyl group or hydrogen.

Particularly preferred are compounds of Formula I in which the sum of all existing subscripts x and y is between the numerical values 2 and 7, and in which substituent $R^1$ represents an alkyl or alkenyl group with essentially 12 to 18 carbon atoms. An optimum of efficacy is observed at a ratio of the total number of ethoxy and hydroxyethyl groups to the number of alkyl, hydroxyalkyl and alkenyl carbon atoms in the ether amine of Formula I of 1/6 to ½, preferably ¼ to 2/5.

The substances of Formula I used in accordance with the invention can be prepared according to methods known in and of themselves by reacting a corresponding fatty alcohol polyglycol ether sulfate with a primary or secondary amine, introducing the substituents $R^2$ and $R^3$ (British Pat. Nos. 1,067,762 and 1,087,413). A carbon-nitrogen bond is formed in these alkylation reactions. An additional manufacturing method (older German Patent Application No. P 3,504,242.7) describes the reaction of a fatty alcohol polyglycol ether sulfate with a tertiary amine which has at least one hydroxyalkyl substituent, thus for example triethanolamine, wherein the alkylation takes place on the hydroxyl group of the hydroxyalkyl residue with formation of a carbon-oxygen bond. The compounds of Formula I produced in this way can if desired by subsequently alkoxylated on the substituents $R^2$ and $R^3$ if these have reactive hydrogens. In general, however, during the direct manufacture, the polyglycol ether group in the fatty alcohol ether sulfate is selected such that together with the ethoxy or hydroxyethyl groups, possibly introduced via the amine, it leads to an optimal balance for the application in accordance with the invention between hydrophobicity and hydrophilicity of the molecule. In this process, some of the ethoxy or hydroxyethyl groups can be replaced by isopropoxy or hydroxyisopropyl groups.

Typical representatives of the compounds of Formula I used in accordance with the invention include, for example, the reaction products of fatty alcohol ether sulfates, which can have different degrees of ethoxylation, with primary amines, e.g., ethanolamine or a $C_1$–$C_4$ alkylamine such as methylamine, or with secondary amines, e.g., diethanolamine, morpholine, or a dialkylamine with $C_1$–$C_4$ alkyl groups such as diethylamine. In particular it involves the reaction products of the fatty alcohol ether sulfates with tertiary amines containing at least one hydroxyethyl group, e.g., triethanolamine, diethanol-methylamine. These substances include, for example, the following compounds: $C_{12}/C_{14}$-(coconut)-alkyl-poly(3,6)-oxyethyl-hydroxyethylamine, $C_{12}/C_{14}$-(coconut)-alkyl-di-(oxyethyl)-hydroxyethyl-ethylamine, $C_{12}/C_{14}$-(coconut)-alkyl-di-(oxyethyl)-hydroxyethyl-methylamine, lauryl-di-oxyethyl-diethylamine, n-octyl-oxyethyldihydroxyethylamine, $C_{12}/C_{14}$-(coconut)-alkyl-di-oxyethyl-dihydroxyethylamine, oleyl-trioxyethyl-dihydroxyethylamine, N-lauryloxyethyl-morpholine, $C_{18}$-alkyl-poly-(6)-oxyethyl-diethanolamine, $C_{12}/C_{14}$-(coconut)-alkyl-poly-(3,6)-oxyethyl-hydroxyethyl-methylamine, $C_{16}/C_{18}$-alkyl-poly-(4,6)-oxyethyl-dihydroxyethyl-amine, $C_{16}/C_{18}$-(tallow)-alkyl/alkenyl-tri-oxyethyl-dihydroxyethylamine (iodine number of the tallow alcohol 110 to 130). Reaction products of the fatty alcohol ether sulfate with the primary, secondary or tertiary amine with at least one hydroxyisopropyl group are also suitable.

The substances used in accordance with the invention have no inherent odor that would interfere with the technology of their application and can be prepared, as far as their long-chain alkyl and alkenyl groups are concerned, from renewable lipid raw materials. Thus these compounds have at least two advantageous properties not shared by the substances known as laundering power-enhancing additives. Detergent mixtures produced using the above-defined ether amines of Formula I show improved fat and pigmented fat washing-out ability; they equal or exceed in this regard the characteristics of the known detergents containing comparable laundering power-enhancing additives.

The ether amines used in accordance with the invention can involve mixtures of substances as a result of the method of their manufacture. Thus, via the raw material fat, fatty alcohol mixtures of certain chain lengths cuts are usually obtained by large industrial scale distillation processes; in the ethoxylation of the fatty alcohols as precursors for fatty alcohol polyglycol ether sulfate manufacture, it is known that ethoxylation mixtures with an average degree of ethoxylation are also obtained. Finally, the reaction of the fatty alcohol ether sulfate with the amine under formation of a C—N or C—O bond can also lead to mixtures when the amine has more than one reactive site, so that the bisalkylation product can also form in smaller amounts.

In the following, the $pK_b$ values for some characteristic ether amines are presented:

$R^1—(OCH_2CH_2)_x—NR^2R^3$ (a) with $R^1=C_{12/14}$-Alkyl-/Alkenylx=3,6 to 4,6

$R^2=R^3=—CH_2CH_2OH$ $pK_b=7,5$ (b) the same, with $R^2=—CH_2CH_2OH$ $R^3=H$ $pK_b=6,7$ (c) with $R^1=C_8H_{17}—$ x=1

$R^2=R^3=—CH_2CH_2OH$ $pK_b=6,3$ (d) the same, with $R^2=R^3=(—OCH_2CH_2)_2H$ $pK_b=6,5$ (e) with $R^1=C_{12/14}$-Alkyl-/Alkenyl x=2

$R^2=H$ $R^3=—CH_2CH_2OH$ $pK_b=6,6$ (f) with $R^1=C_{12}H_{25}—$ x=1

$R^2=CH_3—$ $R^3=—CH_2CH_2OH$ $pK_b=7,5$ (g) with $R^1=C_{12}H_{25}—$ x=1

$R^2=R^3=—CH_2CH_2OH$ $pK_b=8,0$

In the laundry detergent in accordance with the invention, the surfactant combination of at least one surfactant from the group of anionic, nonionic and zwitterionic surfactants and the ether amine of Formula I is preferably present in a quantitative ratio such that the surfactant or surfactant mixture and the ether amine of Formula I are present in quantitative ratios of 30:1 to 2:1, and especially in a ratio of 10:1 to 3:1. Thus, based on the total detergent, the ether amine of Formula I is preferably present in quantities of 0.2 to 10 wt%, preferably 0.5 to 3 wt%. Preferred detergents contain the combination of surfactant or surfactant mixture and the ether amine of Formula I in quantities of 5 to 65 wt%, preferably 8 to 25 wt%, once again based on the total detergent formula. It is a remarkable observation that the laundering power-enhancing action of the ether amines of Formula I occurs both with the synthetic anionic surfactants and with the nonionic surfactants.

In addition, 95 to 35 wt%, preferably 92 to 65 wt% of the ether amine-containing laundry detergent consists of at least one additional laundering and cleaning substance from the group of inorganic and/or organic builders, foam inhibitors, soil suspending agents, optical brighteners, enzymes, dyes and perfumes, as well as water and/or other liquid carriers. Bleaching detergents contain addities comprising peroxy compound, stabilizer, and possibly an activator for the peroxy compounds, in a total quantity of 10 to 40 wt%, especially 15 to 35 wt%, based on the total detergent.

Typical ether amine-containing powdered detergents in accordance with the invention correspond to the following framework formula:

5–50, preferably 5–25 wt% of at least one surfactant from the group of sulfonate and sulfate surfactants and the nonionic surfactants of the type of alkanols or alkenols substituted with hydrophilic nitrogen-free groups, 0.3–5, preferably 0.5–2.5 wt% of the ether amines of Formula I, wherein the surfactants and the ether amines are preferably present in a ratio of 10:1 to 3:1, 0–8, preferably 0.2 to 5 wt% of a foam inhibitor from the group of alkali soaps with essentially $C_{18}$–$C_{22}$-fatty acid esters, and the nonsurfactant foam inhibitors, 50–94.7, preferably 55 to 90 wt% powdered organic and inorganic builders, possibly including a bleaching component, and 0–10, preferably 0.5 to 10 wt% customary detergent additives from the group of optical brighteners, enzymes, soil suspending agents, corrosion inhibitors, textile softeners, antimicrobial active ingredients, colorings and perfumes.

Typical ether amine-containing liquid detergents in accordance with the invention differ from the powdered formulas through increased surfactant and reduced builder fractions and the absence of a bleach component. Such detergents correspond to the following framework formula:

10–60, preferably 15 to 50 wt% of at least one surfactant from the group of sulfonate and sulfate surfactants the nonionic surfactants of the type of alkanols or alkenols of $C_{12}$–$C_{18}$ soaps with predominant fraction of soaps of chain lengths $C_{12}$–$C_{14}$, substituted with hydrophilic nitrogen-free groups, preferably a mixture of the synthetic anioninc, nonionic and soap surfactants, 0.5–8, preferably 0.8 to 6 wt% of the ether amines of Formula I, wherein the surfactants and the ether amines are preferably present in a ratio of 20:1 to 5:1, 0–20, preferably 1 to 15 wt% organic and/or inorganic builders, 10–89.5, preferably 15 to 60 wt% liquid carriers from the group of water-soluble lower alcohols, diols and ether alcohols, and water, and 0–10, preferably 0.5 to 10 wt% of the usual additives, already designated in the preceding for powdered detergents.

In the case of the typical ether amine-containing pasty detergents in accordance with the invention, the liquid fraction consists largely and preferably almost exclusively of nonionic surfactants, so that the share of liquid carriers is distinctly reduced compared to the liquid detergents. Preferred pasty formulations get by without liquid carriers, which themselves provide no contribution to the laundering powder; in particular, these formulations contain practically no free water, which means that they contain less than 2 wt% water not bound to the individual components in any form as water of hydration. A corresponding framework formula for paste detergents has the following composition:

30–60, preferably 35 to 55 wt% surfactant existing completely or mostly as such in liquid form, especially nonionic surfactants of the type of alkanols or alkenols substituted with hydrophilic nitrogen-free groups, 1–10, preferably 2 to 8 wt% of the ether amines of Formula I, wherein the surfactants and the ether amines are preferably present in a ratio of 20:1 to 5:1, 0–8, preferably 0.2 to 6 wt% of a foam inhibitor from the group of the soaps, especially the potassium soaps and particularly the $C_{12}$–$C_{18}$ potassium soaps, and the nonsurfactant foam inhibitors, 10–69, preferably 20 to 50 wt% organic and/or inorganic builder substances, if desired including a bleach component, and 0–10, preferably 0.5 to 10 wt% of the usual detergent additives already mentioned for the other framework formulas.

A particularly preferred embodiment of the invention concerns a powdered detergent for low laundering temperatures which preferably contains a bleaching component consisting of peroxy compound, cold bleach activator and stabilizer, and which together with a low-phosphate or phosphate-free builder component has a special surfactant combination. The use of this detergent at low laundering temperatures leads to outstanding cleaning performance even against stubborn fat and fat/pigment soils on the usual textile fabrics, thus on cotton, polyester and mixed fabrices. This special surfactant combination is made up on the basis of a mixture of nonionic surfactants of at least two separately produced low ethoxylated $C_{12}$–$C_{18}$ alkanols or alkenols with a cloud point in the range of 0–45, preferably 5–40 (measured in water). In addition to these nonionic surfactants of relatively low solubility, at least one readily water-soluble anionic sulfonate and/or sulfate surfactant is present in sufficient quantities with regard to the nonionic ethoxylates, so that for example 10 parts by weight of the nonionic surfactant mixture are present per 3–9 parts by weight of the sulfonate or sulfate surfactant. As an additional constituent essential for the invention this surfactant combination contains 1–5 parts by weight of an ether amine of Formula I, once again based on 10 parts by weight of the nonionic surfactant mixture.

This surfactant combination, especially preferred for ether amine-containing laundry detergents, can be a constituent of a low-phosphate or phosphate-free laundry detergent formulation in quantities of about 8–30 wt%, wherein the term "low phosphate" is oriented with respect to the maximum permissible values of the applicable phosphate tolerance ordinance, which at present in the case of a universal laundry detergent formulation with the usual recommended addition rate corresponds to a quantity of about 25 wt% sodium tripolyphosphate relative to the total amount of powder detergent, wherein this value can also be higher in the case of lower dosed detergent concentrates.

The foaming ability of such detergents can be reduced by adding a nonsurfactant foaming inhibitor in quantities of 0.2–0.8 wt% or of 0.5–5 wt% of an alkali soap consisting of mostly $C_{16}$–$C_{20}$ fatty acids or a mixture of the nonsurfactant foam inhibitor and the soap, in a quantity of 0.2–5 wt%, in each case based on the total detergent, in such a manner that neither overfoaming nor difficulties in rinsing out arise upon utilization in washing machines.

Suitable synthetic anionic surfactants especially include those of the types of the sulfonates and sulfates. As surfactants of the sulfonate type, alkylbenzene sulfonates with a $C_{9-15}$ alkyl group, olefin surfonates, i.e., mixtures of alkene and hydroxyalkane sulfonates, as well as disulfonates, as are obtained for example from $C_{12}$–$C_{18}$ monoolefins with terminal or internal double bonds by sulfonating with gaseous sulfur trioxide followed by alkaline or acid hydrolysis of the sulfonation product come under consideration. Also suitable are the alkane sulfonates, which can be obtained from $C_{12}$–$C_{18}$ alkanes by sulfochlorination or sulfoxidation and subsequent hydrolysis or neutralization, or by bisulfite addition to olefins, as well as the esters of alpha-sulfo fatty acids, e.g., the alpha-sulfonated methyl or ethyl esters of the hydrogenated coconut, palm kernel or tallow fatty acids. Suitable surfactants of the sulfate type are the sulfuric acid monoesters from primary alcohols of natural or synthetic origin, i.e., from fatty alcohols, e.g., coconut fatty alcohols, tallow fatty alcohols, oleyl alcohol, lauryl, myristyl, palmityl or stearyl alcohol, or the $C_{10}$–$C_{20}$ oxoalcohols, and the secondary alcohols of these chain lengths. The sulfuric acid monoesters of the aliphatic primary alcohols ethoxylated with 1 to 6 mol ethylene oxide or ethoxylated secondary alcohols are also suitable. Sulfated fatty acid alkanolamides and sulfated fatty acid monoglycerides are also suitable.

Suitable anionic surfactants on a natural raw material basis, in addition to the detergent-active soaps, i.e., the salts of especially the $C_{12}$–$C_{18}$ fatty acids, also include the water-soluble salts of the acylcyanamides of the formula RCONH—CN, wherein R represents an alkyl or alkenyl group with 9 to 23 carbon atoms, preferably 11 to 17 carbon atoms. These anionic surfactants are present in the form of their sodium, potassium or ammonium salts, or in the form of the soluble salts with organic bases, especially of mono-, di- or triethanolamine.

Particularly important as nonionic surfactants are the addition products of 3 to 20 mol ethylene oxide to primary $C_{10}$–$C_{20}$ alcohols, e.g., to coconut or tallow fatty acohols, to oleyl alcohol, to oxo alcohols, or the secondary alcohols of this chain length. In addition to water-soluble nonionics includes in this group, the low ethoxylated fatty alcohol polyglycol ethers with 3 to 7 ethylene glycol ether residues in the molecule, which are not soluble or not completely soluble in water, are of particular interest, especially when they are used together with water-soluble nonionic or anionic surfactants.

In combination with the low ethoxylated fatty alcohol polyglycol ethers, suitable nonionic surfactants also include the water-soluble addition products, containing 20 to 250 ethylene glycol ether groups and 10 to 100 propylene glycol ether groups, of ethylene oxide to polypropylene glycol, alkylenediamine polypropylene glycol, and to alkylpolypropylene glycols with 1 to 10 carbon atoms in the alkyl chain, in which the polypropylene glycol chain functions as a hydrophobic group. Nonionic surfactants of the type of amine oxides or sulfoxides are also usable, for example the compounds N-coconut alkyl-N,N-dimethylamine oxide, N-tallow alkyl-N,N-dihydroxyethylamine oxide. Additional suitable components of the surfactant combination also include the water-soluble alkylglucosides, the hydrophobic $C_8$–$C_{20}$ group of which is linked with a generally oligomeric, hydrophilic glucoside residue. The preferred nonionic surfactants are the alkanols or alkenols substituted with ethoxy groups as hydrophilic nitrogen-free groups. The term "nonionic surfactants (nonionics)" thus does not include the ether amines of Formula I used in accordance with the invention.

The foaming ability of the surfactants can be increased or reduced by combining suitable surfactant types. A reduced foaming capacity of the wash bath is generally desirable when working in washing machines. In the case of soaps, the foam damping increases with the degree of saturation and the number of carbon atoms in the fatty acid residue; soaps of the saturated $C_{20}$–$C_{24}$ fatty acids and therefore especially suitable as foam dampers for detergents on the basis of sodium triphosphate as builders, while in the detergents containing mostly zeolites, $C_{14}$–$C_{18}$ soaps already show good foam inhibition, especially at low laundering temperatures. The nonsurfactant foam inhibitors generally involve water-soluble compounds, mostly containing $C_8$–$C_{22}$ hydrocarbon residues. Corresponding foam inhibitors include, for example, N-alkylaminotriazines with essentially 8 to 18C atoms in the alkyl group, aliphatic $C_{18}$–$C_{40}$ ketones, e.g., stearone, and especially paraffins and haloparaffins with melting points below 100° C. and silicone dispersions on the basis of organopolysiloxanes and microfine silicas, which can likewise be silanized.

Suitable organic and inorganic builder substances for ether amine-containing detergents preferably include alkaline salts, especially alkali salts, which cannot only precipitate calcium ions or complex them, but also if possible bring about a synergistic enhancement of the laundering power with the surfactants, and have soil retaining properties. Of the inorganic salts, the water-soluble alkali metaphosphates or alkali polyphosphates, especially pentasodium triphosphate, are always of particular significance. In addition to these phosphates, organic complexing agents for calcium ions and heavy metal ions can be present. These include compounds of the type of aminopolycarboxylic acids, e.g., nitrilotriacetic acid, ethylene diaminetetraacetic acid, diethylene triaminepentaacetic acid, and other homologs. Suitable phosphorus-containing organic complexing agents include the water-soluble salts of alkanepolyphosphonic acids, amino- and hydroxyalkane polyphosphonic acids and phosphonopolycarboxylic acids, e.g., the compounds methane diphosphonic acid, dimethylaminoethane-1,1-diphosphonic acid, aminotrimethylene triphosphonic acid, ethylenediamine tetramethylene tetraphosphonic acid, diethylene triamine pentamethylene pentaphosphonic acid, 1-hydroxyethane-1,1-diphosphonic acid, [and] 2-phosphonobutane-1,2,4-tricarboxylic acid.

Among the organic builder substances, the N- and P-free polycarboxylic acids, forming complex salts with calcium ions, including carboxyl group-containing polymers, are of particular significance. Low molecular weight compounds such as citric acid, 2,2'-oxydisuccinic acid or carboxymethyl oxysuccinic acid compounds are suitable. Suitable polymeric polycarboxylic acids have a molecular weight of 350 to about 1,500,000 in the form of the water-soluble salts. Preferably preferred polymeric polycarboxylates have a molecular weight in the range of 500 to 175,000, and especially in the range of 10,000 to 100,000. These include compounds such as polyacrylic acid, poly-alpha-*hydroxyacrylic acid, polymaleic acid, and the copolymers of the corresponding monomeric carboxylic acids with one another or with ethylenically unsaturated compounds, such as vinylmethyl ether. The water-soluble salts of polyglyoxylic acid are also usable.

*Three lines of text duplicated at this point in original German; intentionally omitted from translation—Tr.

An additional constituent of the builder components consists of a homopolymeric and/or copolymeric carboxylic acid or a sodium or potassium salt thereof, wherein the sodium salts are preferred. Suitable homopolymers are polyacrylic acid, polymethacrylic acid and polymaleic acid. Suitable copolymers are those of acrylic acid or methacrylic acid with maleic acid, or copolymers of acrylic acid, methacrylic acid or maleic acid with vinyl ethers, such as vinylmethyl ether or vinylethyl ether, as well as with vinyl esters, such as vinyl acetate or vinyl propionate, acrylamide, methacrylamide, as well as with ethylene, propylene or styrene. In such copolymeric acids, in which one of the components has no acid function, in the interests of sufficient water solubility the fraction thereof amounts to no more than 70 mol%, preferably less than 60 mol%. Copolymers of acrylic acid with maleic acid, as are characterized in greater detail for example in European Pat. No. 25,551-B1, have proven particularly suitable. These involve copolymers which contain 40 to 90 wt% acrylic acid or methacrylic acid and 60 to 10 wt% maleic acid. Particularly preferred are copolymers in which 45 to 85 wt% acrylic acid and 55 to 15 wt% maleic acid are present. The molecular weight of the homo- and copolymers generally amounts to 1000 to 150,000, preferably 1500 to 100,000.

An additional constituent of the builder component consists of sodium silicate of the composition $Na_2O:SiO_2=1:2$ to 1:3.5, preferably 1:2.5 to 1:3.3. Mixtures of silicates with different alkali contents can also be used, for example a mixture of $Na_2O:SiO_2=1:2$ and $Na_2O:SiO_2=1:2.5$ to 3.3.

Suitable water-insolube inorganic builder substances include the fine particulate, synthetic, bound water-containing sodium aluminosilicates of the zeolite A type, described in greater detail in German Patent Application No. 2,412,837 as phosphate substituents for laundry and cleaning detergents.

The cation-exchanging sodium aluminosilicates are used in the usual hydrated, fine crystalline form, i.e., they contain practically no particles greater than 30μ in size, and consist to the extent of at least 80% of particles less than 10μ in size. Their calcium binding capacity, which is determined according to the statements of German Pat. No. 2,412,837, falls in the range of 100 to 200 mg CaO/g. Zeolite NaA is especially usable, as is also zeolite NaX and mixtures of NaA and NaX.

Suitable inorganic, noncomplexing salts are the bicarbonates, carbonates, borates, sulfates or silicates of the alkalies, also known as "laundry alkalies".

Additional builder substances, which are mostly used in liquid agents because of their hydrotropic properties, include the salts of the noncapillary active sulfonic acids, carboxylic acids and sulfocarboxylic acids containing 2 to 9C atoms, for example the alkali salts of alkane-, benzene-, toluene-, xylene- or cumene-sulfonic acids, sulfobenzoic acids, sulfophthalic acid, sulfoacetic acid, sulfosuccinic acid, as well as the salts of acetic acid or lactic acid. Acetamide and urea are also suitable as solubilizing agents.

The zeolite content of the agents amounts to 10–40 wt%, preferably 12–20 wt%, the content of polymeric or copolymeric carboxylic acids or their salts 0.5–5 [wt%], preferably 0.8–4 wt%, and of sodium silicate, 1–7 wt%, preferably 2–6 wt%.

Additional suitable builder salts are sodium carbonate and—as long as no objections exist against the simultaneous use of small amounts of phosphates—polyphosphates, especially pentasodium tripolyphosphate. The share of these under the conditions mentioned can amount to as much as 25 wt%, preferably 5–22 wt%. In cases where phosphates cannot be used, replacement by sodium nitrilotriacetate in quantities of, for example, 2–10 wt% also comes under consideration. Other known water-soluble phosphate substitutes can also be utilized simultaneously if desired, for example polyacetals of glyoxylic acid in the form of the sodium salts.

The builder salts also include the sequestration agents for the class of aminopolycarboxylic acids and polyphosphonic acids, usually present in comparatively small amounts, acting as so-called co-builders, stabilizers and antiprecipitants (threshold substances). The aminopolycarboxylic acids include ethylenediamine tetraacetic acid, diethylenetriamine pentaacetic acid, and the higher homologs thereof. Suitable polyphosphonic acids include 1-hydroxyethane-1,1-diphosphonic acid, aminotri-(methylenephosphonic acid), ethylenediaminetetra-(methylenephosphonic acid) and its higher homologs, e.g., diethylenetriaminetetra-(methylenephosphonic acid). The above-mentioned carboxylic acids or polyphosphonic acids are usually used in the form of the sodium or potassium salts. The quantity used generally amounts to 0.1–5 wt%, preferably 0.2–1 wt%.

The other usual detergent components include antigraying substances, optical brighteners, enzymes, bleaching agents and bleach activators, foam inhibitors, dyes and perfumes, biocides, neutral salts, as well as substances which improve the powder texture.

Suitable antigraying agents include cellulose ethers, such as carboxymethylcellulose, methylcellulose, hydroxyalkylcelluloses, and mixed ethers, such as methylhydroxyethylcellulose, methylhydroxypropylcellulose and methyl-carboxymethylcellulose. Also suitable are mixtures of various cellulose ethers, especially mixtures of carboxymethylcellulose and methylcellulose.

Suitable optical brighteners are alkali salts of 4,4-bis-(2″-anilino-4″-morpholino-1,3,5-triazinyl-6″-amino)-stilbene-2,2′-disulfonic acid or compounds of similar structure bearing a diethanolamine group in place of the morpholino group. Brighteners of the type of the substituted diphenylstyryls also come under consideration, e.g., the alkali salts of 4,4′-bis-(2-sulfostyryl)-diphenyl, 4,4′-bis-(4-chloro-3-sulfostyryl)-diphenyl and 4-(4-chlorostyryl-4′-(2-sulfostyryl)-diphenyl.

Enzymes coming under consideration include those from the classes of proteases, lipases and amylases, or mixtures thereof. Especially suitable are enzymatic active ingredients obtained from bacterial strains or fungi, such as *Bacillus subtilis, Bacillus licheniformis* and *Streptomyces griseus.* The enzymes can be embedded in enveloping substances to protect them against premature decomposition.

As bleaching components, the perhydrates and per compounds usually used in laundering and bleaching agents come under consideration. The perhydrates preferably include sodium perborate, which can exist as the tetrahydrate or the monohydrate, as well as the perhydrates of sodium carbonate (sodium percarbonate), sodium pyrophosphate (perpyrophosphate), sodium silicate (persilicate) and urea. These perhydrates are preferably used together with bleach activators.

Sodium perborate tetrahydrate in combination with bleach activators preferably comes under consideration as a bleaching component. The bleach activators especially include N-acyl compounds and O-acyl compounds. Examples of suitable N-acyl compounds include multiply acylated alkylenediamines, such as tetraacetylmethylenediamine, tetraacetylethylenediamine and their higher homologs, as well as acylated glycolurils, such as tetraacetylglycoluril. Additional examples include Na-cyanamide, N-alkyl-N-sulfonyl-carbonamides, N-acylhydantoins, N-acylated cyclic hydrazides, triazoles, urazoles, diketopiperazines, sulfurylamides, cyanurates and imidazolines. As O-acyl compounds, in addition to carboxylic acid anhydrides, such as phthalic acid anhydride, and esters, such as Na-(iso)-nonanoylphenolsulfonate, especially acylated sugars such as glucose pentaacetate come under consideration. Preferred bleach activators are tetraacetylethylenediamine and glucose pentaacetate. The bleach activators can also be coated with enveloping substances to avoid interactions with the per compounds, especially during storage of the powdered mixtures.

Suitable foam inhibitors and organopolysiloxanes and their mixtures with microfine, possibly silanized silicas, paraffins, waxes, microcrystalline waxes and mixtures thereof with silanized silica, as well as saturated fatty acids with 18 to 24C atoms and their alkali soaps. Mixtures of different foam inhibitors, e.g., consisting of silicones and paraffins, are also usable.

Neutral salts, especially sodium sulfate as well as magnesium silicate, acting as a stabilizer for per compounds, come under consideration as further constituents.

The other detergent constituents can be present in quatities generally customary in known laundry detergent compositions. The fraction of graying inhibitors generally amounts to 0.2–2 wt%, the fraction of optical brighteners, 0.05–0.5 wt%. The share of enzymes depends mainly on their activity. Technical enzyme preparations, which are usually mixed with stabilizers, calcium salts and diluents, and adjusted to a certain activity, are usually used in fractions of 0.1–2 wt%. The perborate share usually amounts to 5–25 wt%. The quantity of bleach activators used likewise depends on their activity. Highly effective activators, such as tetraacetylethylenediamine, are usually used in quantities of 0.5–5 wt%. This is also true by analogy for foam inhibitors, the fraction of which in the case of highly effective silicone defoamers can generally amount to 0.01–0.5 wt%, or in the case of waxy or paraffin materials or higher molecular weight fatty acids, up to 2 wt%. The sodium sulfate fraction can amount to 25 wt%, or in special cases even more.

Additional detergents in accordance with the invention contain 1–5 wt% amidoamine of Formula II, wherein the amidoamine is derived from fatty acids whose acyl residue ($R^4$—CO—) has 12 to 18C atoms, wherein at least 50 wt% have 12 to 14C atoms and wherein the sum of the carbon atoms contained in the residues $R^5$, $R^6$, $R^7$, and also surfactants containing polyglycol ether groups, insoluble to partly soluble in water, absorbed on a granular carrier material, and consisting of (i) ethoxylated, linear or methyl-branched in 2-position, saturated or singly unsaturated primary $C_{16}$–$C_{18}$ alcohols with an average of 4 to 6 glycol ether groups, (ii) ethoxylated, linear or methyl-branched in 2-position, saturated primary $C_{10}$–$C_{14}$ alcohols with an average of 4 to 6 glycol ether groups, wherein the weight ratio of (i):(ii):the amidoamine is equal to 1:(2 to 6):(0.8 to 2.5) and the weight ratio of (i+ii+amidoamine):the builder substances amounts to 4:1 to 1:2, and it also contains water-soluble surfactants of the sulfonate type and/or the sulfate type.

The nonionic surfactants consist of a mixture of selected nonionic surfactants which, because of their relatively low degree of ethoxylation, are not or are only partially soluble in water, but are dispersable. Their HLB values are below 12, generally between 6 and 11.5.

The nonionic surfactant presented under (i) is derived from primary fatty alcohols or natural or synthetic origin, which may be saturated, singly unsaturated, linear, or methyl-branched in 2-position (oxo group). The starting materials used are preferably linear fatty alcohols, i.e., cetyl alcohols, stearyl alcohol, oleyl alcohol, and mixtures thereof, e.g., tallow fatty alcohol. The average number of glycol ether groups is 4 to 6, especially 5. Corresponding to the statistical distribution customary in polyglycol ethers, mixtures are involved which can also contain fractions with lower and higher degrees of ethoxylation. However, the statistical maximum or the average degree of ethoxylation, as indicated, should amount to 4–6, preferably 5. The HLB value of the (i) fraction is between 7.5 and 10, preferably 8.2 to 9.3.

The nonionic surfactant presented under (ii) is likewise derived from fatty alcohols or oxo alcohols with 10 to 14C atoms. Linear alcohols with 12 to 14C atoms are preferably used as starting materials, i.e., lauryl alcohol and myristyl alcohol as well as mixtures thereof. Especially usable are $C_{12}$–$C_{14}$ alcohol mixtures derived from coconut fatty alcohols, wherein the fraction of shorter-chain alcohols is advantageously below 5 wt%. The average number of ethylenepolyglycol ether groups is 4 to 6, especially 5. In terms of the statistical distribution of the glycol ether groups, the information presented under Section (i) applies analogously. The HLB value of the (ii) fraction is between 8.5 and 12, preferably between 9 and 11.5.

The aminoamide is derived from saturated or singly unsaturated fatty acids with 10 to 18, preferably 12 to 18C atoms, wherein particular preference is given to fatty acids whose acyl residues consist to the extent of more than 50 wt%, especially to the extent of more than 65 wt%, of those with 12 to 14C atoms. Especially suitable are mixtures obtained from coconut fatty acids, from which the fraction with 10 or less C atoms has been largely separated. The diamine group is derived from alkylated diamines, such as ethylenediamine, 1,3-propylenediamine and 1,4-butylenediamine. Methyl, ethyl, propyl or isopropyl groups come under consideration as alkyl groups. The sum of the carbon atoms in the residue $(CH_2)_n$ and the residues $R^5$ to $R^7$ should preferably amount to 4 to 6. Examples of such compounds are N,N-dimethylethylenediamine, N,N-dimethylpropylenediamine, N-methyl-N-ethyl-ethylenediamine, N,N'-dimethyl-ethylenediamine, N,N'-dimethyl-propylenediamine, N-methyl-N'-ethyl-propylenediamine, and mixtures of such alkylated alkylenediamines. Particularly preferred are compounds of Formula II, in which $R^4$ represents an alkyl group with 9 to 17C atoms, wherein at least 50% of the groups $R^4$ contain 11 to 13C atoms, the residue $R^5$ represents H, $R^6$ and $R^7$ represent methyl and/or ethyl groups and n=3.

The weight ratio (i):(ii):aminoamide amounts to 1:(2–6):(0.8–2.5), preferably 1:(3–5):(1–2), wherein in the preferred range a particularly well balanced relationship exists in terms of the cleaning ability, especially with regard to fatty and oily soils. The content of aminoamide in the agent preferably amounts to 1–5 wt%.

Suitable anionic surfactants of the sulfonate or sulfate type include those previously discussed in the case of ether amine-containing laundry detergents.

The weight ratio of the nonionic component (surfactant+aminoamide) to anionic component is 4:1 to 1:2, especially 2:1 to 1:1. In this range the laundering power with respect to both fatty and mineral soils is especially distinct. The content of the above-mentioned surfactants in the agent amounts to a total of 10–25 wt%, preferably 12–20 wt% in this case.

The materials previously described in the case of the ether amine-containing detergents serve as builder materials or builder salts.

The agents in accordance with the invention exist as granular powders or powdered mixtures, which can be obtained in a suitable manner by granulation, spray drying, spray mixing, homogenization, or a combination of these methods. Since the nonionic surfactants and the aminoamides consist of liquid compounds with a tendency to sticking, which on the basis of their tendency to "pluming" are of only limited suitability for spray drying, it is often necessary for them to be adsorbed to a carrier substance. Suitable carrier substances include the builders, especially zeolite, phosphates, silicates, nitrilotriacetate, and mixtures thereof, as well as spray dried mixtures of builder salts, anionic surfactants and other components, as long as they are stable under the conditions of spray drying. Carrier substances consisting of builder salts can also contain neutral salts, such as sodium sulfate, graying inhibitors, Mg silicate, and additional adsorbents, such as finely divided silica, finely divided aluminum oxide, smectite clays, layer silicates and bentonites. Instead of spray dried mixtures, builder salt mixtures manufactured by buildup granulation can also be used as carrier substances for the nonionic surfactants and the aminoamides. Following application of the liquid components to these carrier materials, the granulates can also be provided with adsorbent coatings that prevent adhesion, which can be accomplished for example by dusting with the above-mentioned fine particulate adsorbents.

A particularly preferred embodiment of the invention consists of the fact that 30–100 wt% of the anionic surfactant exists in the form of a granulate containing the zeolite, the salt of the polymeric or copolymeric carboxylic acid, and the sodium silicate or part of the total amount of sodium silicate present. Suitable granulates have the following compositon (in wt% based on granulate):

60–80%, especially 65–75% zeolite,
3–20%, especially 4–15% polycarboxylic acid salt,
0.1–2%, especially 0.15-1% sodium silicate,
8–18%, especially 10–16% water, which can be removed at a drying temperature of 145° C.,
0.5–5%, preferably 2–4% dispersion stabilizer.

Dispersion stabilizers are defined as compounds used for stabilizing aqueous or pasty zeolite suspensions. They are generally added to those suspensions during their manufacture or to the moist filter cakes, and remian in the zeolites even during further processing. Reference is made in this connection to German Pat. No. 2,527,388. Examples of such stabilizers are neutral salts, such as sodium sulfate, nonionic surfactants from the class of ethoxylated fatty alcohols with 12 to 18C atoms and 3 to 10 glycol ether groups, as well as polymeric and copolymeric carboylic acids. The dispersion stabilizer preferably consists of the nonionic surfactant presented below [sic], or part of it.

The granulate, which is preferably manufactured by spray drying and is described in greater detail in [West German] Patent Application No. P 3,444,960 (D7180), has an average particle size of 0.2–1.2 mm and contains less than 2 wt% of dusty fraction (particle size less than 0.05 mm), and no more than 5 wt% of coarse fraction (particle size greater than 2 mm). Its bulk density is 400 to 700 g/l. It is characterized by a very high adsorption capacity for liquid or pasty materials, and is therefore especially suitable as a carrier substance for the nonionic surfactants.

In an additional, preferred embodiment the agent in accordance with the invention therefore exists as a mixture of several partial powders. The following come under consideration as partial powders:

(A) A partial powder consisting of the previously described granulate of zeolite, (co-)polymeric carboxylic acid salt, sodium silicate, water, and non-ionic dispersion stabilizer, and the nonionic surfactant component adsorbed on this granulate and the amidoamine.

(B) A partial powder consisting of the anionic surfactant component, the builder salts not contained in the granulate, and additional detergent components, insofar as these are suitable for spray drying. These include complexing agents, graying inhibitors, optical brighteners and neutral salts.

(C) One or more partial powders containing components which, for reasons of stability, should not be brought into direct contact with constituents of partial powders (A) and (B) or should not be spray dried. These components include bleaches, bleach activators, foam inhibitors, enzymes, perfumes and biocides. These substances are generally prepared separately or converted to a suitable powder or granulate form and mixed with the other partial powders. Liquid constituents, such as perfume oils, can also be sprayed onto other granular partial powders, for example the perborate, and added to the mixture together with these. The foam inhibitors are also preferably applied to a carrier material with an adsorbing action or embedded in a water-soluble enveloping material in order to protect them against interactions with other powder constituents and the resulting loss of activity.

The subject of the invention is also a method for producing the amidoamine-containing laundry detergents in accordance with the invention. This method consists of the fact that a granulate of the following composition (in wt%)

60–80%, especially 65–75% zeolite,
3–20%, especially 4–15% polycarboyxlic acid salt,
0.1–2%, especially 0.15–1% sodium silicate,
8–18%, especially 10–16% water, which can be removed at a drying temperature of 145° C.
0.5–5%, preferably 2–4% dispersion stabilizer is prepared by spray drying, the granulate is impregnated with a mixture of the nonionic surfactant and the aminoamide, and the partial powder obtained (A) is mixed with a spray dried partial powder (B) according to the above-mentioned composition as well as additional partial powders (C) according to the above-mentioned composition.

In producing the partial powder (A) it is necessary to note that its sodium silicate content is limited. If the sodium silicate content in the laundry detergent is substantially higher for applications-technical reasons, the excessive fraction should be added to the other partial powders, especially the spray dried partial powder (B). Higher fractions of sodium silicate in this granulate than indicated increase its degradability or impair its solubility in the wash liquor. As a result, the liberation of the nonionic surfactant is delayed, which can lead to a worsening of the laundering results. This subdivision of the total amount of sodium silicate present into two different partial powders is an additional aspect of the invention.

Additional information on the production of the granulate and its impregnation with nonionic surfactants can be taken from German Pat. No. 3,444,960 (D 7180), reference to which is explicitly made here.

The agents in accordance with the invention are characterized by a high laundering ability, especially by excellent cleaning power against stubborn fatty soils, for example those consisting of food and gravy residues, sebum, lipstick and mascara. Despite their comparatively high content of liquid nonionic surfactants, they are excellently free flowing and pourable, and show no tendency toward grease breakthrough on cardboard packages. As long as they are prepared according to the preferred procedure, i.e., adsorption of the nonionic surfactant on the previously produced granulate consisting of zeolite, polymeric acid and sodium silicate, the formation of aerosols in the exhaust air from the spray towers is completely avoided.

EXAMPLES

EXAMPLE 1

This example illustrates the increase in the primary laundering power on pigment/fatty soils as well as on bleachable soils under the conditions of machine laundering. The experiments were performed at 40° C. and 60° C. in a Miele W 433 washing machine. Additional experimental information: 1-bath cycle bath ratio 1:5.6 at a wash bath size of about 20 l; detergent concentration 6.9 g/l; water hardness 16° d; determination in triplicate using 3.6 kg clean filling laundry, with in each case 2 swatches (sewed onto the filling laundry) with the test soils indicated below. The following pigment-/fatty soils were used: dust, lanolin on non-surface-finished cotton; dust-sebum on finished cotton, and dust-sebum on cotton/polyester mixed fabrics. Bleachable soils were used those caused by red wine, blackberries, tea and coffee.

Formulation for the test detergent:

4 wt% alkylbenzenesulfonate, 5.5 wt% ethoxylated $C_{12}$-$C_{18}$ coconut fatty alcohol with 5 mol ethylene oxide 20 wt% sodium tripolyphosphate 20 wt% sodium perborate tetrahydrate 15 wt% Zeolite A 5 wt% waterglass $Na_2O.3.35SiO_2$ 3.0 wt% amine compound Remainder up to 100 wt%: perborate stabilizer, soil suspender, silicone antifoam, sodium sulfate and water.

The pH value of a 1 wt% aqueous solution of this detergent was 9.9.

As the amine compound, an ether amine of Formula I, $C_{12}/C_{14}$-coconut alkyl-$(OCH_2CH_2)_{3,6}$—NH—$CH_2CH_2OH$ was used; the $pK_b$ value of this ether amine was 6.7. A comparison was performed with the known laundering power amplifier coconut amine+2 EO.

Result

The mean values of the individual reflectance values were determined ($\phi$% R). In the case of the 40° C. laundering, the value of 63.8 $\phi$% R was obtained, and for the known laundering power intensifiers, the value 62.9. In the case of the bleachable soils, as the corresponding reflectance values, 61.9 was found for the formulation in accordance with the invention, and 60.8 for the known laundering power enhancer. In the case of the 60° C. laundering, the corresponding reflectance values were 69.4 and 69.0 (pigment/fat), and 68.6 and 67.8 (bleachable spots).

In addition, the two test detergents of this example were given to a panel of 3 experienced individuals for odor testing and compared with the detergent without the laundering power-enhancing additive. For the formulation in accordance with the invention with the ether amine of the above-mentioned composition, only a slight inherent odor was found, which was substantially lower than the odor of the formulation with coconut amine+2 EO.

Summary

The reflectance values of the formulation in accordance with the invention are slightly, but significantly, higher than the values of the comparison detergent. The inherent odor of the ether amine is substantially slighter than that of coconut amine+2 EO, which is of great significance in the case of the perfuming of the detergent power, as is required on the market.

Analogous results are also obtained if the above-mentioned ether amine of Formula I is replaced by one of the following ether amines: $C_{12/14}$-coconut alkyl-di-oxyethyl-dihydroxyethylamine; $C_{12/14}$-coconut alkyl-di-oxyethyl-hydroxyethyl-methylamine; $C_{12/14}$-coconut alkyl-di-oxyethyl-N-morpholine; $C_{16/18}$-tallow alkyl-tetra-oxyethyl-dihydroxyethylamine. The $pK_b$ values of these compounds were all above 4.5.

Example 2

According to the statements of German Pat. No. DE 3,344,960 (D 7180), an absorptive granulate of the following composition was prepared by spray drying (PW=parts by weight):

| | |
|---|---|
| 46.7 PW | Zeolite NaX (based on anhydrous substance) |
| 5.0 PW | copolymer (sodium salt) |
| 0.14 PW | sodium silicate |
| 1.56 PW | ethoxylated tallow alcohol (part of component (i)) |
| 0.6 PW | sodium sulfate |
| 13.6 PW | water, of which 8.9 PW was removable at 145° C. |
| 67.6 PW | |

The zeolite used had a particle size of 1 to 8 microns, wherein the fraction over 8 microns amounted to 6 wt%. Shares over 20 microns did not exist. As the polycarboxylic acid, a copolymer of acrylic acid and maleic acid with an average molecular weight of 70,000 (Sokalan CP5 ®) in the form of the sodium salt was used. As the ethoxylated fatty alcohol, a tallow alcohol (30% cetyl alcohol, 70% stearyl alcohol) reacted with 5 mol ethylene oxide (EO) was used (corresponds to part of the component (i)).

The particle size spectrum obtained by screen analysis gave the following weight distribution:

| mm | over 1.6 | up to 0.8 | up to 0.4 | up to 0.2 | up to 0.1 | under 0.1 |
|---|---|---|---|---|---|---|
| wt-% | 0 | 1 | 37 | 53 | 9 | 0 |

The bulk density was 550 g/l.

67.6 parts by weight of the granulate were sprayed in a spray mixing tower, consisting of a cylindrical drum inclined with respect to the horizontal, equipped with mixing means and spray nozzles (Lödige Mixer) with a molten mixture of the nonionic surfactant and the aminoamide described in more detail below. The temperature of the granulate was 20° C., and that of the surfactant melt 50° C. The surfactant mixture consisted of 4.1 parts by weight tallow alcohol with 5 EO (remaining fraction of component (i)[)], 20 parts by weight of a lauryl alcohol-myristyl alcohol mixture (2:1) with 5 EO (component (ii)) and 8.3 parts by weight of the aminoamide N-coconut-acyl-N'-dimethylpropylenediamine, wherein the acyl residue represents a $C_{12}$–$C_{18}$ mixture with an average chain length of 13.5. The $pK_b$ value of the aminoamide is 5.9. After cooling, a non-sticky, granular product was obtained, the free-flowing ability of which was excellent, despite the fact that it contained a total of 34 wt% liquid nonionic surfactant. The bulk density was 740 g/l.

30 parts by weight of the granulate impregnated with the nonionic surfactant and the aminoamide (partial powder A) were mixed with 54.7 parts by weight of a mixture of a spray dried powder (partial powder B) and sodium sulfate (as weight compensation). The spray powder contained sodium dodecylbenzenesulfonate, sodium tripolyphosphate, sodium ethylenediamine tetramethylene phosphate (EDTMP), cellulose ether, sodium silicate, optical brighteners, and a further fraction of sodium sulfate. As additional powder components, granulated enzymes, granulated silicone defoamers, sodium perborate and granulated tetraacetylethylenediamine (TAED) were mixed in. These powdered or granular constituents were summarized under the term "Partial Powder C"; the fraction of this amounts to a total of 15.3 parts by weight.

The compositions of this agent as well as of additional agents prepared in the same way are shown in Table 1 (in wt%).

The pH value of 1 wt% aqueous solutions of this laundry detergent was 10.5.

Comparison experiments were performed with artificially soiled textile samples. The samples, applied to cotton textiles under reproducible conditions, consisted of makeup cream, mascara and lipstick. The samples were placed together with 3 g ballast laundry in conventional household washing machines (capacity 4 kg dry laundry) and washed at a temperature of 60° C. (easy care cycle with 20 min prewash at 25° C.). The laundering time, including heating in the main wash cycle, was 40 min, the detergent concentration was 7.5 g/l, the ratio of textile quantity (in kg) to wash liquor (in liters) was 1:10, the water hardness of the tap water was 16° dH (160 mg CaO per liter). After rinsing 3 times, the laundry was spun, dried, and the reflectance of the samples determined photometrically. The results (Table III) are mean values of 5 laundering experiments with 6 replicates in each case.

TABLE III

| | Makeup | Lipstick | Mascara | Mean value |
|---|---|---|---|---|
| Example 1 | 60 | 57 | 50 | 56 |
| Example 2 | 65 | 60 | 52 | 59 |
| Example 3 | 64 | 60 | 54 | 59 |
| Example 4 | 56 | 57 | 54 | 56 |
| Experiment 1 | 35 | 52 | 33 | 40 |
| Experiment 2 | 40 | 44 | 34 | 39 |
| Experiment 3 | 42 | 45 | 41 | 43 |

TABLE 1

| | 1 | 2 | 3 | 4 |
|---|---|---|---|---|
| $C_{16}$-$C_{18}$ alcohol + 5 EO | 1.7 | 1.4 | 1.5 | 1.4 |
| $C_{12}$-$C_{14}$ alcohol + 5 EO | 6.0 | 4.5 | 5.0 | 4.5 |
| N—acyl-N'—dimethyl-propylenediamine | 2.5 | 3.0 | 3.0 | 2.0 |
| Na—dodecylbenzene sulfonate | 6.0 | 8.0 | 7.0 | 7.0 |
| zeolite (anhydrous) | 14.0 | 14.0 | 14.0 | 14.0 |
| acrylic acid-maleic acid copolymer | 1.5 | 1.5 | 1.5 | 1.5 |
| Na—tripolyphosphate | 20.0 | 20.0 | 20.0 | 20.0 |
| EDTMP | 0.3 | 0.3 | 0.3 | 0.3 |
| sodium silicate (of which 0.04% was in the granulate) | 4.0 | 4.0 | 4.0 | 4.0 |
| cellulose ether | 0.5 | 0.5 | 0.5 | 0.5 |
| optical brightener | 0.2 | 0.2 | 0.2 | 0.2 |
| enzyme | 0.5 | 0.5 | 0.5 | 0.5 |
| defoamer granulate (silicone fraction 30%) | 0.3 | 0.3 | 0.3 | 0.3 |
| sodium perborate | 12.0 | 12.0 | 12.0 | 12.0 |
| TAED | 2.5 | 2.5 | 2.5 | 2.5 |
| sodium sulfate | 17.5 | 16.8 | 17.1 | 16.8 |
| water | remainder | remainder | remainder | remainder |

For comparison, laundry detergents were used which, with a composition otherwise the same as in Example 2, contained the following surfactants (see Table II):

TABLE II

| | Experiment | | |
|---|---|---|---|
| | 1 | 2 | 3 |
| Na—dodecylbenzene-sulfonate | 7.0 | 5.0 | 10.2 |
| tallow alcohol + 5 EO | 6.0 | 2.0 | 3.0 |
| tallow alcohol + 15 EO | 2.2 | 7.2 | — |
| coconut alkylamine + 2 EO | — | — | 2.0 |

The tallow alcohol and coconut alkyl residues were identical with those used in the example in terms of their qualitative and quantitative composition. The compositions in Experiments 1 and 2 correspond to the surfactant compositions of commercial heavy-duty detergents. Experiment 3 corresponds to agents in accordance with U.S. Pat. No. 3,925,224. The results show the superiority of the agents in accordance with the invention.

Example 3

In a laundry detergent of the following composition 2 wt% alkylbenzenesulfonate
3 wt% soap on the basis of hydrogenated tallow fatty acid
10 wt% $C_{13/15}$ oxo-alcohol + 5 mol ethylene oxide
20 wt% zeolite NaA
20 wt% sodium tripolyphosphate
5 wt% waterglass 1:3.35
20 wt% sodium perborate
10 wt% sodium sulfate Remainder: Water 2.5 and 5 wt% sodium sulfate were replaced by an equal quantity of various N-alkylmorpholines. Using the morpholine-containing detergents, laundering experiments were performed in the Launderometer at 40° C., 30 min, textile/bath ratio 1:30 with 6.6 g detergent per liter at a water hardness of 16° d. The textiles were artificially soiled with fat. The laundering power of the morpholine-containing detergent was compared with that of the morpholine-free detergent by measuring the reflectance on the laundered textiles. The following results were obtained, as presented in Table IV.

The laundering power-enhancing effect of the N-alkylmorpholines is apparent.

A 1 wt% solution of the laundry detergent had a pH value between 9.5 and 10. The $pK_b$ values of the morpholine derivatives were as follows:

N-hexylmorpholine: 6.3
N-octylmorpholine: 7.4
N-dodecylmorpholine: 8.7

TABLE IV

| | % Reflectance |
|---|---|
| detergent without additive | 45.9 |
| detergent + 2.5 wt-% N—hexylmorpholine | 54.6 |

TABLE IV-continued

| | % Reflectance |
|---|---|
| detergent + 5.0 wt-% N—hexylmorpholine | 55.1 |
| detergent + 2.5 wt-% N—octylmorpholine | 54.9 |
| detergent + 5.0 wt-% N—octylmorpholine | 55.8 |
| detergent + 2.5 wt-% N—dodecylmorpholine | 54.3 |
| detergent + 5.0 wt-% N—dodecalmorpholine [sic] | 54.7 |

Example 4

A complete laundry detergent of the following composition:

5.0 wt% alkylbenzenesulfonate
4.6 wt% of a mixture of 8 parts $C_{12/18}$ fatty alcohol+5 mol ethylene oxide and 2 parts $C_{12}/C_{14}$ fatty alcohol+3 mol ethylene oxide
0.8 wt% tallow alcohol+5 mol ethylene oxide
0.3 wt% tallow alcohol+14 mol ethylene oxide
21.3 wt% sodium tripolyphosphate
13.9 wt% Zeolite A
0.25 wt% ethylene diamine tetramethylene phosphonic acid
1.20 wt% polycarboxylate
0.5 wt% cellulose ether
4.6 wt% waterglass, $Na_2O:SiO_2=1:3.35$
0.1 wt% magnesium silicate
22.2 wt% sodium perborate
1.6 wt% tetraacetyl ethylenediamine
8.3 wt% sodium carbonate
Remainder: water, dye, perfume was compared in terms of laundering performance with a detergent in accordance with the invention, which instead of 4.6 wt% of the above-mentioned fatty alcohol ethoxylate mixture contained only 2 wt% of this fatty alcohol ethoxylate, but in place of this contained an additional 2 wt% laundering power-enhancer in the form of 4-(2-hydroxydodecyl-)morpholine ($pK_b$ value 7.8). Cotton artificially soiled with lanolin from the Krefeld Laundry Research Institute was used as the test textile. Laundering was performed in an automatic household washing machine at a washing temperature of 90° C. The pH value of a 1 wt% aqueous solution of the detergent in accordance with the invention was 9.9. The reflectance value of the test textile laundered with the detergent in accordance with the invention was significantly higher, by 4 units, than the reflectance value of the test textile laundered with a detergent having a higher surfactant content but no laundering power-enhancer.

We claim:

1. A laundry detergent composition comprising at least one anionic or nonionic surfactant and an aliphatic amine compound, wherein said amine compound has a $pK_b$ value of at least 14 minus the pH value of a 1% aqueous solution of said detergent composition, said amine compound consisting essentially of an alkyl, alkenyl or hydroxyalkyl derivative of glucamine or morpholine wherein the alkyl, alkenyl or hydroxyalkyl group has 6 to 22 carbon atoms.

2. A laundry detergent composition in accordance with claim 1 wherein said $pK_b$ value is between about 4 and about 9.

3. A laundry detergent composition in accordance with claim 1 comprising:

(a) about 3 to about 40%/wt of said anionic or nonionic surfactant;
(b) about 0.1 to about 5%/wt of said amine compound;
(c) about 5 to about 80%/wt of water-soluble or water-insoluble inorganic or water-soluble organic builder salts;
(d) from 0 to about 30%/wt of inorganic per-compounds capable of releasing $H_2O_2$ in aqueous systems; and
(e) the remainder, other constituents customary present in laundry detergents.

4. A laundry detergent composition in accordance with claim 1 wherein said anionic or nonionic surfactant and said amine compound are present in a ratio of from about 30:1 to about 2:1, respectively.

5. A laundry detergent composition in accordance with claim 1 wherein said amine compound is present in a quantity of from about 0.2 to about 10%/wt, based on the weight of said composition.

6. A laundry detergent composition in accordance with claim 1 wherein said surfactant and said amine are present in a quantity of from about 5 to about 65%/wt, based on the weight of said composition.

7. A laundry detergent composition in accordance with claim 1 wherein about 30 to about 100 wt% of said anionic surfactant is present in the form of a granulate comprising about 60 to about 80% by weight of a finely-divided, crystalline synthetic zeolite, about 3 to about 20% by weight of an alkali metal salt of a polycarboxylic acid, about 0.1 to about 2% by weight of a sodium silicate, about 8 to about 18% by weight of water which is removable at a drying temperature of about 145° C., and about 0.5 to about 5% by weight of a dispersion stabilizer.

* * * * *